United States Patent [19]

Foldes

[11] 4,222,017

[45] Sep. 9, 1980

[54] ROTATABLE POLARIZATION DUPLEXER

[75] Inventor: Peter Foldes, Wayne, Pa.

[73] Assignee: RCA Corporation, New York, N.Y.

[21] Appl. No.: 904,340

[22] Filed: May 9, 1978

[51] Int. Cl.[2] ..... H01P 5/20; H01Q 5/00

[52] U.S. Cl. ..... 333/122; 333/135; 333/21 A; 333/209; 343/786

[58] Field of Search ..... 333/6, 21 R, 21 A, 117, 333/122, 135, 137; 343/786, 858

[56] References Cited

U.S. PATENT DOCUMENTS

| | | | |
|---|---|---|---|
| 2,961,618 | 11/1960 | Ohm | 333/21 R X |
| 3,287,730 | 11/1966 | Kerr | 333/21 R X |
| 3,731,235 | 5/1973 | Ditullio et al. | 333/6 |
| 3,731,236 | 5/1973 | Ditullio et al. | 333/21 A X |
| 3,938,157 | 2/1976 | Brickey | 343/786 X |

*Primary Examiner*—Paul L. Gensler
*Attorney, Agent, or Firm*—H. Christoffersen; Samuel Cohen; Joseph D. Lazar

[57] ABSTRACT

The cavity of a rotatable cylindrical waveguide supports the $TE_{11}$ mode of propagation of a received wave and a transmitted wave. The proximal and distal ends of the cylindrical waveguide are adjacent and axially aligned with one end of a rectangular flexible waveguide and a fixedly disposed horn aperture, respectively. The transmitted wave propagates in the $TE_{10}$ mode through the rectangular waveguide to the cylindrical waveguide. Additionally, the rectangular waveguide prevents propagation therethrough of the received wave. The cylindrical waveguide couples the transmitted wave to the horn. Rotation of the end of the rectangular waveguide rotates the polarization of the transmitted wave. A pair of slots in the cylindrical waveguide form passageways between the cavity thereof and a pair of filters that pass the received wave whereby the received wave propagates through the filters. Rotation of the cylindrical waveguide rotates the polarization of the received wave within the filters relative to the polarization of the received wave within the cylindrical waveguide.

7 Claims, 8 Drawing Figures

ROTATABLE POLARIZATION DUPLEXER

BACKGROUND OF THE INVENTION

1. Field of Invention

This invention relates to propagation of orthogonally polarized electromagnetic waves and more particularly to compensating for a loss of orthogonality of polarization due to Faraday rotation in the ionsphere.

2. Description of the Prior Art

A transponder is a device that transmits a signal in response to receiving a signal. A plurality of transponders may, for example, be included in a payload of a communication satellite. A transponder of the satellite typically amplifies and filters a signal received from a first earth station, thereby providing a signal that is transmitted to a second earth station. The satellite's transponder increases the distance over which information may be transmitted from the first earth station.

The signals transmitted to and from the satellite are typically of first and second polarizations, respectively, that are orthogonal to each other. Because of the orthogonal polarizations, the signals may be transmitted to and from the satellite simultaneously, at the same frequency, via one antenna and processed independently of each other. Satellite communication systems that use the orthogonal polarizations of the signals at the same frequency are sometimes known as spectrum reuse systems.

In a spectrum reuse system, an antenna of an exemplary earth station is preferably in a position of alignment with a polarization of an antenna of the satellite's transponder thereby providing a communication link between the exemplary earth station and the satellite. However, the preferable position of the antenna of the exemplary earth station is rotated by ionspheric and atmospheric propagation conditions. Moreover, the rotation of the preferable position is a function of the frequency of a signal and whether the signal is transmitted to the antenna of the transponder or transmitted from the antenna of the transponder. The rotation of the preferable position caused by the change in the propagation conditions is known as Faraday rotation.

In the absence of atmospheric phenomena, such as rain, orthogonally polarized waves that propagate between an earth station and a satellite have an almost entirely predictable Faraday rotation. Therefore, in the absence of rain, elements of an antenna may be rotated in a predetermined manner to compensate for Faraday rotation.

At many small earth stations, only signals within a transmit band of frequencies of a given polarization are transmitted. Additionally, only signals within a receive band of frequencies (different from the transmit band) of a given polarization are received. Since Faraday rotation is a function of frequency, compensation for Faraday rotation at the transmit frequencies is different from compensation at the receive frequencies. There is a need for a simple, economical apparatus for compensating for Faraday rotation at a small earth station of the type described hereinbefore.

SUMMARY OF THE INVENTION

According to the present invention, a first flexible waveguide supports the $TE_{10}$ mode of propagation of a first wave and prevents propagation of a second wave. The first waveguide has a transition end adjacent and axially aligned with the proximal end of an axially rotatable cylindrical waveguide. The waves propagate within the cylindrical waveguide in the $TE_{11}$ mode and within a fixedly disposed aperture structure adjacent and axially aligned with the distal end of the cylindrical waveguide. A port within the wall of the cylindrical waveguide is connected through a filter to a second flexible waveguide. The filter passes the second wave and rejects the first wave.

DETAILED DESCRIPTION

Figure 1:
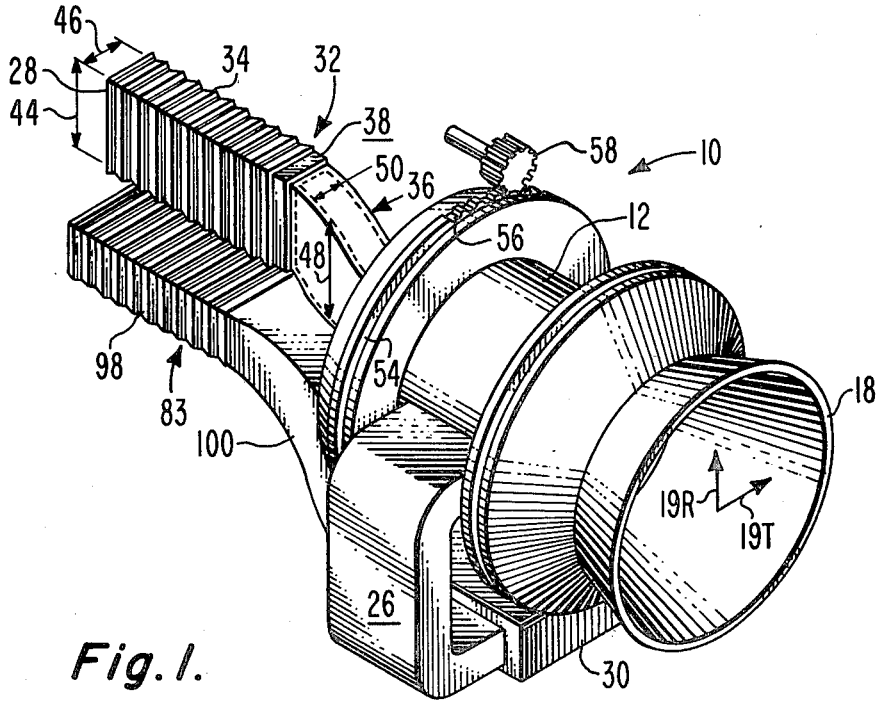
FIG. 1 is a perspective view of the preferred embodiment of the present invention.
Figure 2:
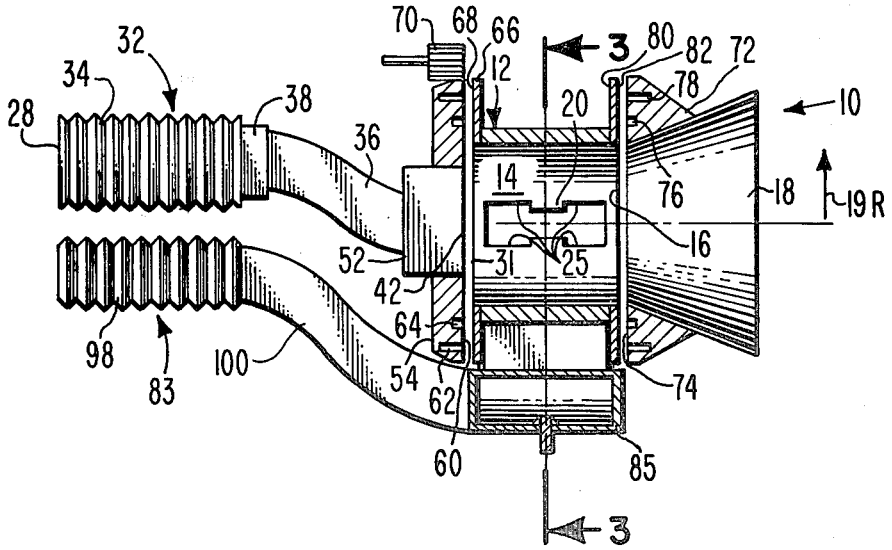
FIG. 2 is a side elevation, with parts broken away, of the embodiment of FIG. 1.
Figure 3:
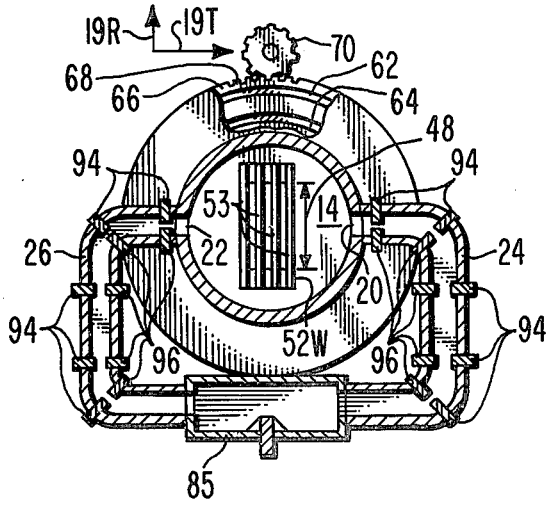
FIG. 3 is a sectional view of FIG. 2 taken along the line 3—3.

The present invention is a duplexer having elements that are rotatable to compensate for Faraday rotation. As shown in FIGS. 1–3, in a first embodiment of the present invention, a polarization duplexer 10 is comprised of an axially rotatable cylindrical waveguide 12 supported in any suitable manner such as by a bearing assembly for a rotary joint well known in the art. Waveguide 12 has a cavity 14 (FIGS. 2 and 3) wherein a received wave and a transmitted wave propagate in the $TE_{11}$ mode. As explained hereinafter, waveguide 12 is rotated to compensate for the Faraday rotation of the received wave.

The received wave is associated with a frequency within an exemplary satellite communication band that extends from 3.7 GHz to 4.2 GHz (referred to as a four GHz band). The transmitted wave is associated with a frequency within an exemplary satellite communication band that extends from 5.925 GHz to 6.425 GHz (referred to as a six GHz band). In an alternative embodiment, the waves may be associated with other frequencies.

The diameter of cavity 14 is selected to prevent the waves from propagating in high order modes ($TE_{20}$, etc.). As known to those skilled in the art, the waves do not propagate in such high order modes when cavity 14 is arranged by suitable design not to support high order modes of propagation of a wave associated with a frequency of 6.425 GHz (the highest frequency of the six GHz band). When cavity 14 has a 5.11 cm diameter, for example, the waves do not propagate in high order modes.

The distal end 16 of waveguide 12 (FIG. 2) is maintained in any suitable manner adjacent and axially aligned with a fixedly disposed axially symmetric radiating horn 18. Horn 18 forms the aperture of duplexer 10. It should be understood that the received wave propagates to waveguide 12 via horn 18. The assumed direction of polarization of the received wave is represented by the direction of an arrow 19R.

Correspondingly, the transmitted wave propagates to horn 18 via waveguide 12. The direction of polarization of the transmitted wave is represented by the direction of an arrow 19T (FIGS. 1 and 3). In the absence of Faraday rotation, the received wave is polarized orthogonal to the transmitted wave and the directions of arrows 19R and 19T are orthogonal to each other.

Waveguide 12 is connected to similar symmetric bandpass filters 24 and 26 (FIGS. 1 and 3). Diametrically opposed slots 20 and 22 in the wall of waveguide 12 provide passageways between cavity 14 and the inputs of filters 24 and 26, respectively.

The cross-section of the cavities of filters 24 and 26 is similar to the cross-section of slots 20 and 22. Additionally, long edges 25 of slots 20 and 22 are parallel to the axis of waveguide 12. As explained hereinafter, filters 24 and 26 are for coupling the received wave from cavity 14 to a fixedly disposed receiver (not shown). Additionally, filters 24 and 26 (terminating in slots 20 and 22) are substantially a short circuit for the transmitted wave, thereby allowing the transmitted wave to pass to horn 18 without attenuation. Because slots 20 and 22 are a short circuit, cavity 14 is a contiguous cylindrical coupler of the transmitted wave to horn 18.

The transmitter (not shown) referred to hereinbefore is suitably connected to the distal end 28 of a flexible waveguide 32 (FIGS. 1 and 2). The transmitted wave is coupled to waveguide 12 through the proximal end 31 thereof (FIG. 2) from the transmitter through waveguide 32.

Waveguide 32 includes a flexible waveguide section 34 (hereinafter at times referred to simply as a "flex section") connected to a cutoff section 36 through a quarter wave transformer 38 (FIGS. 1 and 2). Flex section 34 has a cavity defined by flexible sheet metal reinforced with a flexible plastic coating whereby flex section 34 may be bent and twisted. Accordingly, the proximal end 42 (FIG. 2) of waveguide 32 is moveable with respect to the distal end 28. As explained hereinafter, proximal end 42 is rotated to compensate for the Faraday rotation of the transmitted wave. Flexible waveguides are well known in the microwave art.

A wide dimension 44 (FIG. 1) of the cavity of flex section 34 is of a size that supports the $TE_{10}$ mode of propagation of the transmitted wave with substantially no losses. A narrow dimension 46 of flex section 34 is of any convenient size.

A wide dimension 48 of the cavity of cutoff section 36 is selected to provide a cutoff frequency of waveguide 32 slightly less than the six GHz band. Hence, cutoff section 36 supports the $TE_{10}$ mode of propagation of the transmitted wave and rejects propagation of the received wave. Therefore, only the transmitted wave propagates through waveguide 32. The cutoff frequency is provided when, for example, dimension 48 is 2.65 cm.

Because of the cutoff frequency, cutoff section 36 is lossy. Therefore, it is desirable that cutoff section 36 have only a length necessary for adequate rejection of the received wave.

The cavity of cutoff section 36 is selected to have a narrow dimension 50 of less than half the wavelength of the received wave associated with the highest frequency of the four GHz band. As known to those skilled in the art, the selection of dimension 50 prevents the propagation of the received wave.

The difference between the cross-section of the cavities of sections 34 and 36 causes the characteristic impedances of sections 34 and 36 to differ. Transformer 38 is a rectangular waveguide chosen to match flex section 34 to cutoff section 36. More particularly, transformer 38 has a length of about one quarter of the wavelength of the transmitted wave. Additionally, the cavity of transformer 38 has cross-sectional dimensions that provide a characteristic impedance equal to the geometric mean of the characteristic impedances of sections 34 and 36. Transformer 38 is of a type well known in the microwave art.

A quarter wave transformer 52 (FIG. 2) of the type described hereinbefore is located near proximal end 42. Transformer 52 has one end connected to cutoff section 36 and the other end maintained in any suitable manner adjacent and axially aligned with waveguide 12. The cavity of transformer 52 has cross-sectional dimensions that provide a characteristic impedance equal to the geometric mean of the characteristic impedances of cutoff section 36 and waveguide 12.

Because the transmitted wave propagates through waveguide 32 in the $TE_{10}$ mode, the direction of arrow 19T is perpendicular to the walls indicated by dimension 48 (FIG. 1) and a wide side wall 52W of transformer 52 (FIG. 3). Since the transmitted wave from waveguide 32 propagates through cavity 14 in the $TE_{11}$ mode, proximal end 42 may be rotated to cause a corresponding rotation of the direction of polarization of the transmitted wave in cavity 14.

Preferably, a plurality of parallel conductive plates 53 (FIG. 3) are disposed within the cavity of transformer 52. Plates 53 are oriented orthogonal to the direction of polarization of the transmitted wave within transformer 52. Hence, plates 53 do not affect the transmitted wave. However, plates 53 are substantially parallel to the direction of polarization of the received wave in cavity 14. Therefore, plates 53 are a short circuit to the received wave. Since the ends of plates 53 are adjacent cavity 14, plates 53 inhibit the propagation of the received wave from cavity 14 to the cavity of transformer 52.

Transformer 52 is integral with an annular coaxial flange 54 having gear teeth 56 formed along a portion of the edge thereof (FIG. 1). Teeth 56 mesh with a pinion 58 which is driven in any suitable predetermined manner to rotate proximal end 42 to compensate for the Faraday rotation of the transmitted wave.

Flange 54 additionally has a surface 60 provided with annular slots 62 and 64 of rectangular cross-section (FIGS. 2 and 3). As explained hereinafter, slots 62 and 64 are used to form chokes that inhibit radiation losses from proximal ends 31 and 42.

Waveguide 12 has an annular coaxial flange 66 having a surface 68 opposite surface 60. In this embodiment, the depth of annular slots 62 and 64 are substantially one quarter wavelength of the transmitted and received waves, respectively. Slots 62 and 64 and surface 68 form chokes of a well known type that reflect the transmitted and received waves that radiate thereto from proximal ends 31 and 42.

Waveguide 12 is rotated by a suitable arrangement of a pinion (similar to pinion 58) engaging teeth (not shown) on waveguide 12 (similar to teeth 56).

Horn 18 has a coaxial flange 72 with a face 74 provided with annular slots 76 and 78, similar to slots 62 and 64, respectively. Additionally, waveguide 12 has a flange 80 with a surface 82 opposite surface 74. Accordingly, surface 82 and slots 76 and 78 form chokes similar to those described hereinbefore thereby inhibiting radiation losses near distal end 16.

Figure 4:
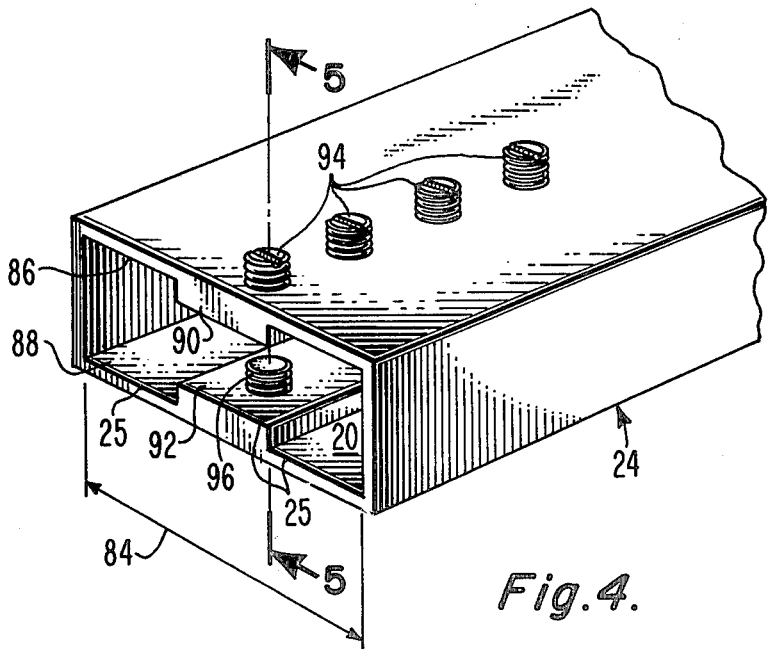
FIG. 4 is a perspective view, with parts broken away, of one of two filters in the embodiment of FIG. 1.
Figure 5:
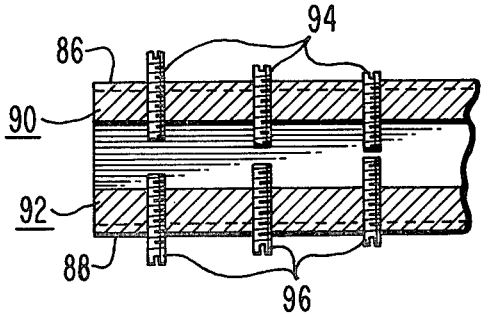
FIG. 5 is a sectional view of FIG. 4 taken along the line 5—5.

As shown in FIGS. 4 and 5, filter 24 referred to hereinbefore, connects slot 20 to a flexible rectangular waveguide 83 through an H plane hybrid coupler 85 of any suitable type. Filter 26, similar to filter 24, also connects corresponding slot 22 to the waveguide 83 through coupler 85.

Filter 24 is comprised of a rectangular waveguide. A dimension 84 of edges 25 is chosen to cause filter 24 to support the $TE_{10}$ mode of propagation of the received wave. The received wave is launched through slot 20 polarized orthogonal to edges 25 (in the general direction of arrow 19R), whereby the received wave propagates through filter 24.

When the direction of polarization of the received wave in cavity 14 in parallel to the direction of polarization of the received wave in filter 24 near slot 20, waveguide 12 is in a desired position relative to the direction of polarization of the received wave. Rotation of waveguide 12 correspondingly rotates the direction of polarization of the received wave in filter 24 relative to the direction of polarization of the received wave in cavity 14. Accordingly, waveguide 12 may be rotated to compensate for the Faraday rotation of the received wave.

The top wall 86 and the bottom wall 88 of filter 24 are respectively integral with similar opposed ridges 90 and 92 that are parallel to the axis of filter 24. Ridges 90 and 92 have threaded holes therethrough that retain similar threaded rods 94 and 96, respectively, at intervals of approximately one quarter wavelength of the received wave. Within filter 24, rods 94 and 96 form coupling obstacles. As well known to those skilled in the art, opposed rods 94 and 96 near the ends of filter 24 are preferably further apart than those near the center of filter 24.

Because of the spacing of rods 94 and 96, there is substantially no attenuation of the received wave that propagates from cavity 14 through filter 24. However, the spacing causes a substantial attenuation of the transmitted wave, thereby causing slot 20 to be substantially a short circuit to the transmitted wave. It should be understood that filter 26 is similar to filter 24. Filters 24 and 26 are of a type well known in the art.

Waveguide 83 (FIGS. 1 and 2), referred to hereinbefore, is comprised of a flexible waveguide section 98 (similar to section 34) that has its distal end connected to a fixedly disposed receiver (not shown). The proximal end of flex section 98 is connected to one end of a waveguide 100. The cross-section of the cavities of flex section 98 and waveguide 100 are similar to each other.

The other end of waveguide 100 is connected to coupler 85, thereby providing a path of propagation of the received wave to the receiver. The received wave propagates through waveguide 83 in the $TE_{10}$ mode. Because of flex section 98, waveguide 12 is rotatable in a predetermined manner to compensate for the Faraday rotation of the received wave.

Figure 6:
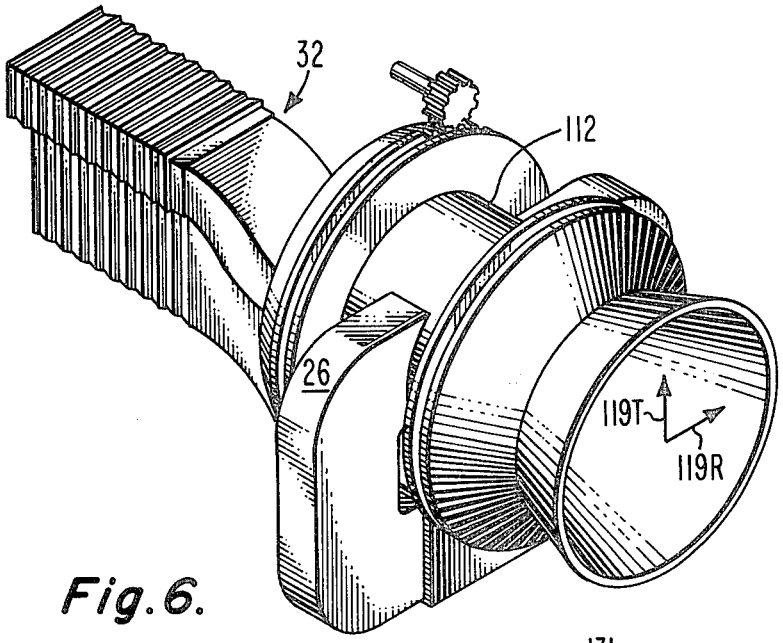
FIG. 6 is a perspective view of an alternative embodiment of the present invention.
Figure 7:
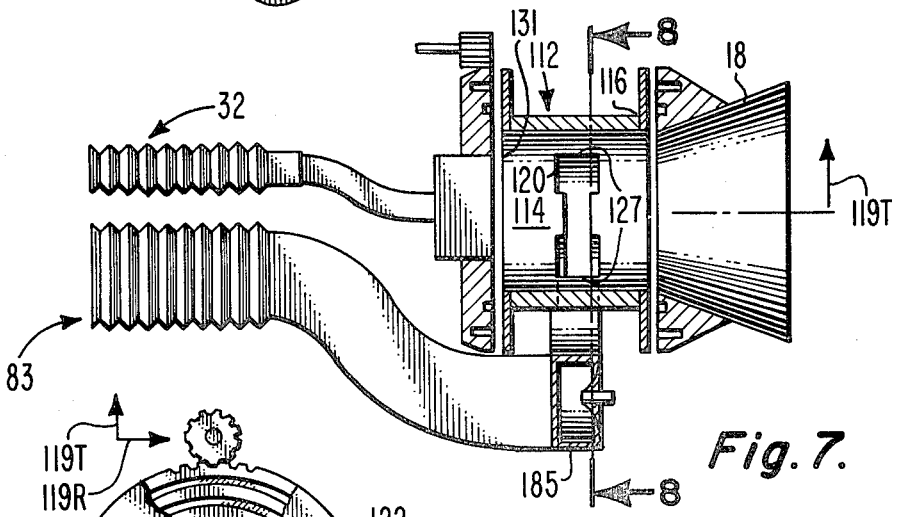
FIG. 7 is a side elevation, with parts broken away, of the embodiment of FIG. 6.
Figure 8:
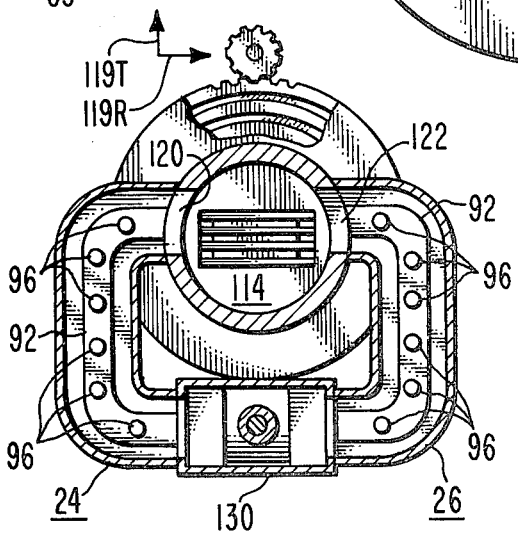
FIG. 8 is a sectional view of FIG. 7 taken along the line 8—8.

As shown in FIGS. 6–8, in a second embodiment of the present invention, a duplexer is comprised of an axially rotatable cylindrical waveguide 112 supported in any suitable manner. Similar to waveguide 12, waveguide 112 has a cavity 114 (FIGS. 7 and 8) wherein the received wave and the transmitted wave propagate in the $TE_{11}$ mode. Moreover, the diameters of cavities 14 and 114 are similar to each other. As explained hereinafter, waveguide 112 is rotated to compensate for the Faraday rotation of the received wave.

Distal end 116 of waveguide 112 (FIG. 7) is maintained adjacent and axially aligned with horn 18. Similar to the first embodiment, the received wave propagates to waveguide 112 via horn 18. However, in the second embodiment the direction of polarization of the received wave is represented by the direction of an arrow 119R (FIGS. 7 and 8). The orientation of the polarized wave as compared to the first embodiment (FIG. 1, 19T and 19R) is, it should be understood, a matter of choice in a design of a system.

Correspondingly, the transmitted wave propagates to horn 18 via waveguide 112. The direction of polarization of the transmitted wave is represented by the direction of an arrow 119T (FIGS. 6 and 8). As in the first embodiment, in the absence of Faraday rotation, the received wave is polarized orthogonal to the transmitted wave, whereby the directions of arrows 119R and 119T are orthogonal.

The transmitted wave is coupled to waveguide 112 through the proximal end 131 thereof from waveguide 32 in the manner described hereinbefore. Similar to the first embodiment, proximal end 42 (FIG. 2) is rotated to compensate for the Faraday rotation of the transmitted wave.

Waveguide 112 is connected to the inputs of filters 24 and 26 through opposed slots 120 and 122, respectively. Slots 120 and 122 are disposed with short edges 127 (FIG. 7) thereof parallel to the axis of waveguide 112.

When the direction of polarization of the received wave in filters 24 and 26 near cavity 114 is perpendicular to the direction of polarization of the received wave in cavity 114, waveguide 112 is in a desired position relative to the direction of polarization of the received wave. A rotation of waveguide 112 rotates the direction of the polarization of the received wave in filters 24 and 26 relative to the direction of polarization of the received wave in cavity 114. Accordingly, waveguide 112 may be rotated in a predetermined manner to compensate for the Faraday rotation of the received wave.

It should be understood that because of the direction of polarization of the received wave and the disposition of slots 120 and 122, waveguide 112 operates as a magic tee coupler with respect to the received wave. Hence, although the directions of polarization of the received wave in slots 120 and 122 may be perpendicular to the direction of the received wave in cavity 114, the directions of polarization of the received wave in slots 120 and 122 are opposite from each other.

The outputs of filters 24 and 26 are connected to waveguide 28 through an E plane hybrid coupler 185 of a well known type that is operated as a power combiner. Because of the opposite directions of polarizations, coupler 185 causes the received waves in filters 124 and 126 to be additively combined and coupled to waveguide 83.

What is claimed is:

1. A rotatable polarization duplexer having a fixedly disposed axially symmetric aperture structure adapted for propagation of first and second polarized waves of differing wavelengths, comprising:

first means including a first flexible waveguide having a cavity that supports the $TE_{10}$ mode of propagation of said first wave, and means for preventing propagation of said second wave;

an axially rotatable cylindrical waveguide that supports the $TE_{11}$ mode of propagation of said waves, said aperture structure being adjacent and axially aligned with the distal end of said cylindrical waveguide and being operatively coupled thereto, said first means having a transition end maintained adjacent and axially aligned with the proximal end of said cylindrical waveguide and operatively coupled between said flexible waveguide and said cylindrical waveguide; and second means including a second flexible waveguide having a cavity that supports the $TE_{10}$ mode of propagation of said second wave;

said second means including means connecting said cylindrical waveguide and said second waveguide for coupling said second wave therebetween and rejecting said first wave;

whereby a structure is provided in which Faraday rotation of either of said waves may be compensated for by rotation of said cylindrical waveguide.

2. The rotatable duplexer of claim 1 wherein said cylindrical waveguide has first and second diametrically opposed slots and said means comprises:

an E plane hybrid coupler connected to said second rigid waveguide;

a first filter connected to said hybrid coupler and to said first slot; and a second filter connected to said hybrid coupler and to said second slot, said filters passing said second wave and rejecting said first wave.

3. The rotatable duplexer of claim 2 wherein said first filter comprises:

a waveguide having a cavity that supports the $TE_{10}$ mode of propagation of said second wave; and a plurality of coupling obstacles fixedly disposed within said first filter equally spaced therein between said first slot and said hybrid.

4. A rotatable polarization duplexer having a fixedly disposed axially symmetric aperture structure adapted for propagation of first and second polarized means of respectively different wavelengths, comprising:

a first waveguide means that supports the $TE_{10}$ mode of propagation of said first wave comprising a first flexible rectangular waveguide coupled to a first rigid rectangular waveguide, said first rigid waveguide arranged to prevent propagation of said second wave, an axially rotatable cylindrical waveguide that supports the $TE_{11}$ mode of propagation of said waves, said cylindrical waveguide being rotatably supported between and in axial alignment with said aperture structure and said first rectangular waveguide to provide a wave propagation path therebetween, a second waveguide means that supports the $TE_{10}$ mode of propagation of said second wave comprising a second flexible waveguide coupled to a second rigid rectangular waveguide, coupling means connected to said cylindrical waveguide and said second rigid waveguide for coupling said second wave therebetween, said coupling means comprising a filter means for passing said second wave and rejecting said first wave, said duplexer being capable thereby of being rotably adjusted to compensated for Faraday rotation of either of said waves.

5. The rotatable duplexer of claim 4 additionally comprising a plurality of parallel conductive plates disposed within said first waveguide means, said plates being perpendicular to the direction of polarization of said first wave.

6. The rotatable duplexer of claim 4 wherein said cylindrical waveguide has first and second diametrically opposed slots and said coupling means comprises:

an H plane hybrid coupler connected to said second rigid waveguide;

a first filter connected to said hybrid coupler and to said first slot; and a second filter connected to said hybrid coupler and to said second slot, said filters passing said second wave and rejecting said first wave.

7. The rotatable duplexer of claim 6 wherein said first filter comprises:

a waveguide having a cavity that supports the $TE_{10}$ mode of propagation of said second wave; and a plurality of coupling obstacles fixedly disposed within said first filter equally spaced therein between said first slot and said hybrid.

* * * * *